US005130610A

United States Patent [19]

Kakitani

[11] Patent Number: 5,130,610

[45] Date of Patent: Jul. 14, 1992

[54] DISCHARGE LAMP LIGHTING APPARATUS

[75] Inventor: Tsutomu Kakitani, Yokohama, Japan

[73] Assignee: Toshiba Lighting & Technology Corporation, Tokyo, Japan

[21] Appl. No.: 647,016

[22] Filed: Jan. 30, 1991

[30] Foreign Application Priority Data

Jan. 31, 1990 [JP] Japan ..... 2-21086
Feb. 28, 1990 [JP] Japan ..... 2-47463

[51] Int. Cl.[5] ..... H05B 41/36; H05B 41/24

[52] U.S. Cl. ..... 315/219; 315/276; 315/DIG. 7; 315/254

[58] Field of Search ..... 315/219, 254, 255, 276, 315/274, 277, DIG. 7, 220, 98, 101, 105, 279, 287, 307, DIG. 2, DIG. 5, 209 R

[56] References Cited

U.S. PATENT DOCUMENTS 3,818,312 6/1974 Luuresema et al. ..... 315/219 X 4,547,705 10/1985 Hirayama et al. ..... 315/219

*Primary Examiner*—Eugene R. LaRoche
*Assistant Examiner*—Ali Neyzari
*Attorney, Agent, or Firm*—Cushman, Darby & Cushman

[57] ABSTRACT

In a discharge lamp lighting apparatus of this invention, an AC voltage of a commercial AC power source is full-wave-rectified by a rectifier, and this full-wave-rectified AC is smoothed by a smoothing circuit connected to the rectifier. An inverter operated by a series resonance circuit constituted by a resonant choke coil and a capacitor is connected to the rectifier, and field-effect transistors are connected to this series resonance circuit. By the operation of the inverter, a high-frequency AC is induced in a output winding of a boosting transformer having an input winding connected in parallel with the capacitor of the series resonance circuit. The output winding then supplies the induced AC to discharge lamps for lighting the discharge lamps.

9 Claims, 7 Drawing Sheets

DISCHARGE LAMP LIGHTING APPARATUS

BACKGROUND OF THE INVENTION

1. Field of the Invention

The present invention relates to a discharge lamp lighting apparatus, and more particularly, to a discharge lamp lighting apparatus using an inverter.

2. Description of the Related Art

A conventionally well known discharge lamp lighting apparatus includes an inverter, a leakage transformer, and is used as an inverter transformer. In such a discharge lamp lighting apparatus, a leakage inductance of the leakage transformer and a capacitor connected to the output side of the leakage transformer constitute a series resonance circuit to perform oscillation.

In the discharge lamp lighting apparatus of this type, however, the size of the inverter transformer is increased because the leakage inductance of the leakage transformer is used as an inductor. Therefore, the size of the discharge lamp lighting apparatus is increased.

SUMMARY OF THE INVENTION

It is, therefore, an object of the present invention to provide a discharge lamp lighting apparatus which can be miniaturized since the size of an inverter transformer is not increased even if an inverter is used.

According to an aspect of the present invention, there is provided a discharge lamp lighting apparatus comprising: DC power source means: inverter means connected to the DC power source means and having a series resonance circuit constituted by an inductor and a first capacitor; transformer means having input and output windings, the input winding being connected in parallel with the first capacitor of the inverter means; and at least one discharge lamp having a pair of filaments connected to the output winding of the transformer means.

BRIEF DESCRIPTION OF THE DRAWINGS

FIGS. 4A and 4B are views each showing the size of a core used in a discharge lamp lighting apparatus, in which FIG. 4A shows a core used in the discharge lamp lighting apparatus shown in FIG. 1 and FIG. 4B shows a core used in a conventional discharge lamp lighting apparatus;

FIGS. 5A and 5B are views each showing the size of a transformer used in a discharge lamp lighting apparatus, in which FIG. 5A shows a transformer used in the discharge lamp lighting apparatus shown in FIG. 1 and FIG. 5B shows a transformer used in a conventional discharge lamp lighting apparatus;

DETAILED DESCRIPTION OF THE PREFERRED EMBODIMENTS

Embodiments of the present invention will be described below with reference to the accompanying drawings.

Figure 1:
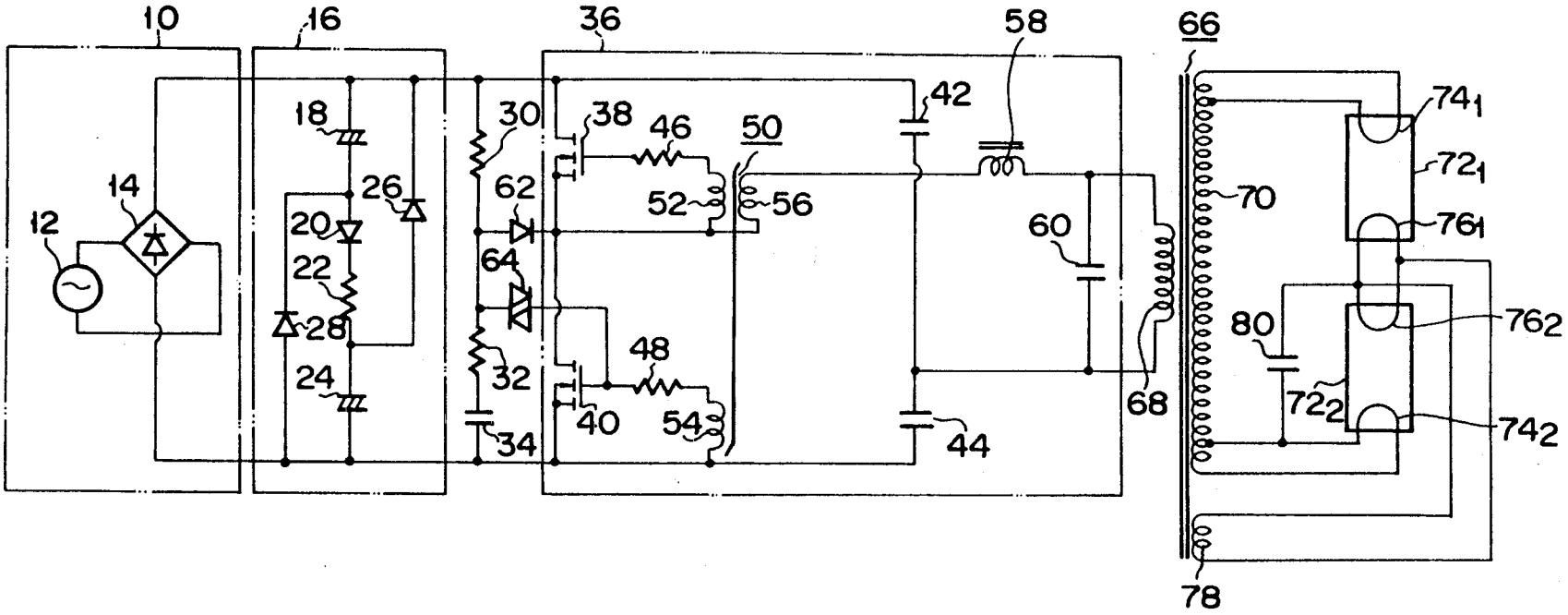
FIG. 1 is a circuit diagram showing the first embodiment of a discharge lamp lighting apparatus of the present invention.

FIG. 1 is a block diagram showing the first embodiment of a discharge lamp lighting apparatus of the present invention. Referring to FIG. 1, reference numeral 10 denotes a DC power source including a commercial AC power source 12 and a rectifier 14 such as a diode bridge having an AC input terminal connected to the power source 12. A smoothing circuit 16 is connected between the D output terminals of the rectifier 14. The smoothing circuit 16 is constituted by a series circuit comprising an electrolytic capacitor 18, a diode 20 having a polarity shown in FIG. 1, a resistor 22, and an electrolytic capacitor 24, a diode 26 having a cathode connected to the positive output terminal of the rectifier 14 and an anode connected to a node between the resistor 22 and the electrolytic capacitor 24, and a diode 28 having a cathode connected to a node between the electrolytic capacitor 18 and the diode 20 and an anode connected to the negative output terminal of the rectifier 14.

A series circuit constituted by resistors 30 and 32, a capacitor 34, and a half-bridge type inverter 36 as a current-resonant type inverter (to be described later) are connected between the output terminals of the rectifier 14.

The inverter 36 includes field-effect transistors 38 and 40 having drains and sources series-connected between the output terminals of the rectifier 14, and to series-connected capacitors 42 and 44. The gates of the field-effect transistors 38 and 40 are connected to first and second windings 52 and 54 of a drive transformer 50 via resistors 46 and 48, respectively. One end of a third winding 56 of the drive transformer 50 is connected to the first winding 52, and its other end is connected to a series resonance circuit constituted by a resonant choke coil 58 and a capacitor 60.

A node between the first and third windings 52 and 56 of the drive transformer 52 is connected to a node between the source of the field-effect transistor 38 and the drain of the field-effect transistor 40 and to a node between the resistors 30 and 32 via a diode 62 having a polarity shown in FIG. 1. A bidirectional two-terminal thyristor (SSS) 64 is connected between the node between the resistors 30 and 32 and the gate of the transistor 40.

An input winding 68 of a boosting transformer 66 is connected in parallel with the capacitor 60 of the series resonance circuit. The two ends of an output winding 70 of the transformer 66 are connected to filaments $74_1$ and $74_2$ of discharge lamps $72_1$ and $72_2$, respectively. The other filaments $76_1$ and $76_2$ of the lamps $72_1$ and $72_2$, respectively, are connected to each other and to a preheating filament 78. In addition, a starting capacitor 80 is connected between the filaments $74_1$ and $74_2$ and the filaments $76_1$ and $76_2$.

An operation of the first embodiment will be described below.

A commercial AC supplied from the commercial AC power source 12 is rectified by the rectifier 14 and smoothed by the smoothing circuit 16. The smoothed current is inverted into a high frequency, and a high-frequency AC is induced in the output winding 70 of the transformer 66, thereby high-frequency-lighting the discharge lamps $72_1$ and $72_2$. In this case, the inverter is high-frequency-oscillated by the resonant choke coil 58 and the capacitor 60.

Figure 2:
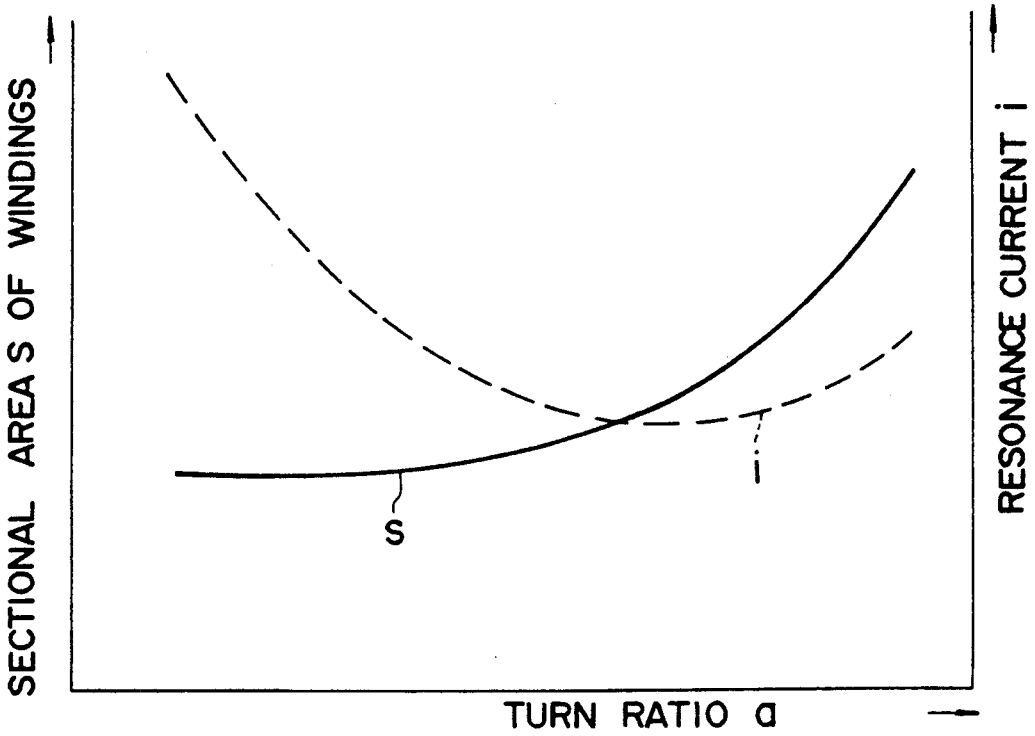
FIG. 2 is a graph showing a relationship of a sectional area and a resonance current with respect to a turn ratio in a winding shown in FIG. 1.

A relationship between a total sectional area S of the windings of the transformer 66 and the resonant choke coil 58 and other variables is represented as shown in FIG. 2. That is, as indicated by a solid curve in FIG. 2, a minimum sectional area is obtained with a predetermined turn ratio a. As indicated by a broken curve in FIG. 2, a relationship between a resonance current i and the turn ratio a is such that the resonance current i is increased when the turn ratio a is increased. Therefore, by selecting the turn ratio a shown in TABLE 1 so as to decrease the values of the total sectional area S of the windings and the resonance current i, miniaturization and reduction in manufacturing cost of an apparatus can be realized.

TABLE 1

| Power Source Voltage | Load | Turn Ratio a |
|---|---|---|
| AC 200 V | 40 W × 2 Lamps | 2 to 3 |
| AC 200 V | 40 W × 1 Lamp | 1 to 1.5 |
| AC 100 V | 40 W × 2 Lamps | 2.5 to 3.5 |
| AC 100 V | 40 W × 1 Lamp | 2 to 3 |

Figure 3:
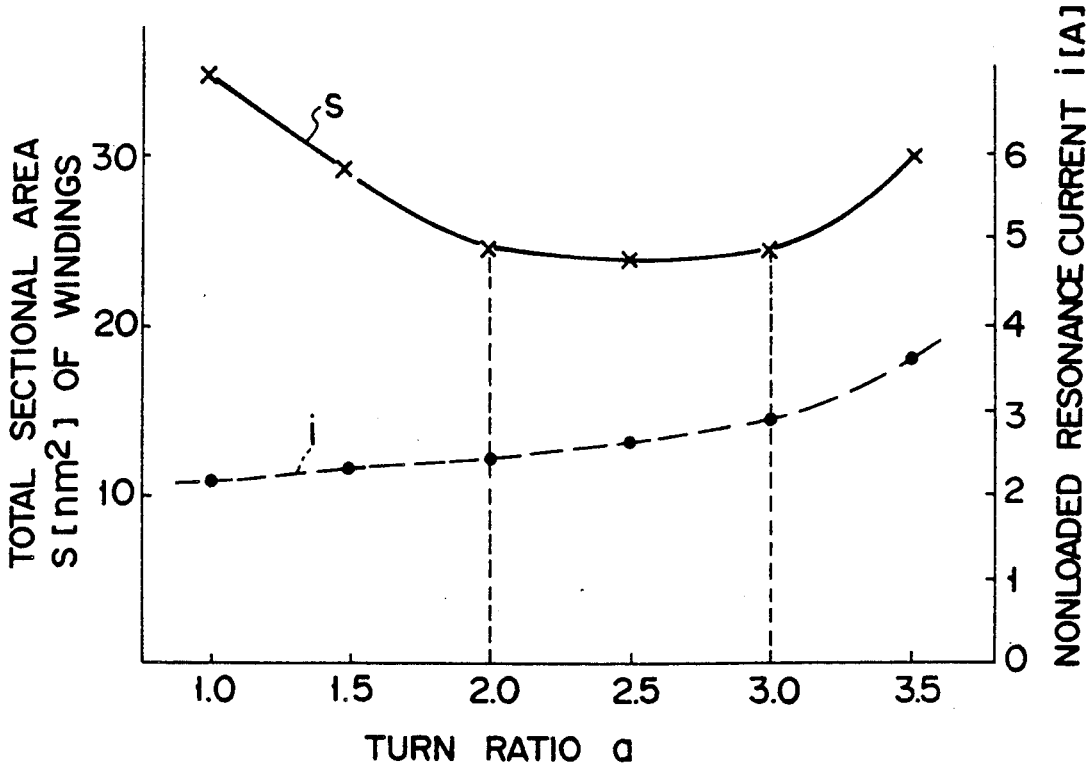
FIG. 3 is a graph showing a relationship of a sectional area and a resonance current with respect to the turn ratio in the winding shown in FIG. 1 represented by experimental values.

TABLE 2 and FIG. 3 show values of the turn ratio a and parameters of the transformer obtained when two discharge lamps having a power source voltage of 200V and a load of 40W were turned on at a frequency of 43 kHz for full power. TABLE 2 and FIG. 3 reveal that values of the turn ratio a shown in TABLE 1 are suitable.

TABLE 2

| Turn Ratio a | Inductance L (mH) | Nonloaded Resonance Current i (A) | Sectional Area ($mm^2$) for Obtaining Current Density of $6A/mm^2$ | Number of Turns Determined by Magnetic Flux Density (Turn) | Total Sectional Area of Windings ($mm^2$) |
|---|---|---|---|---|---|
| 1.0 | 0.92 | 2.18 | 0.36 | 95 | 34.2 |
| 1.5 | 0.58 | 2.32 | 0.39 | 74 | 28.9 |
| 2.0 | 0.53 | 2.42 | 0.40 | 61 | 24.4 |
| 2.5 | 0.43 | 2.64 | 0.44 | 54 | 23.8 |
| 3.0 | 0.35 | 2.94 | 0.49 | 49 | 24.0 |
| 3.5 | 0.28 | 3.68 | 0.61 | 49 | 30.0 |

Figure 4B:
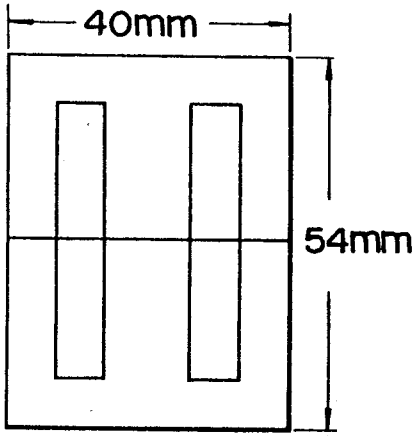
FIG. 4B (PRIOR ART)
Figure 5B:
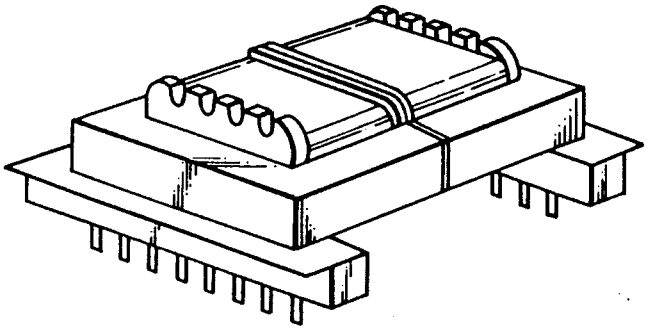
FIG. 5B (PRIOR ART)
Figure 4A:
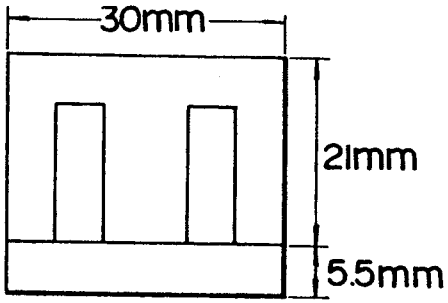
Figure 5A:
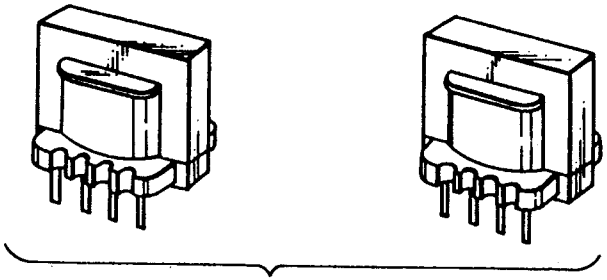

FIGS. 4A and 4B show the sizes of cores used in the discharge lamp lighting apparatus, and FIGS. 5A and 5B show the sizes of transformers used in the discharge lamp lighting apparatus.

As shown in FIGS. 4B and 5B, the leakage transformer of the conventional discharge lamp lighting apparatus must have a large core comprising a pair of E-shaped cores abutting each other, and is inevitably large. In the first embodiment of the present invention, the two transformers (FIG. 4A) used are small since each has a small core comprising an E-shaped core and an I-shaped core. These transformers are so small that the unit formed by them is still smaller than the leakage transformer incorporated in the conventional lighting apparatus, as is evident from FIG. 5A. As a result, the discharge lamp lighting apparatus can be miniaturized.

The second embodiment of the present invention will be described below with reference to FIG. 6. In the following embodiments, the same reference numerals denote the same parts and a detailed description thereof will be omitted.

Figure 6:
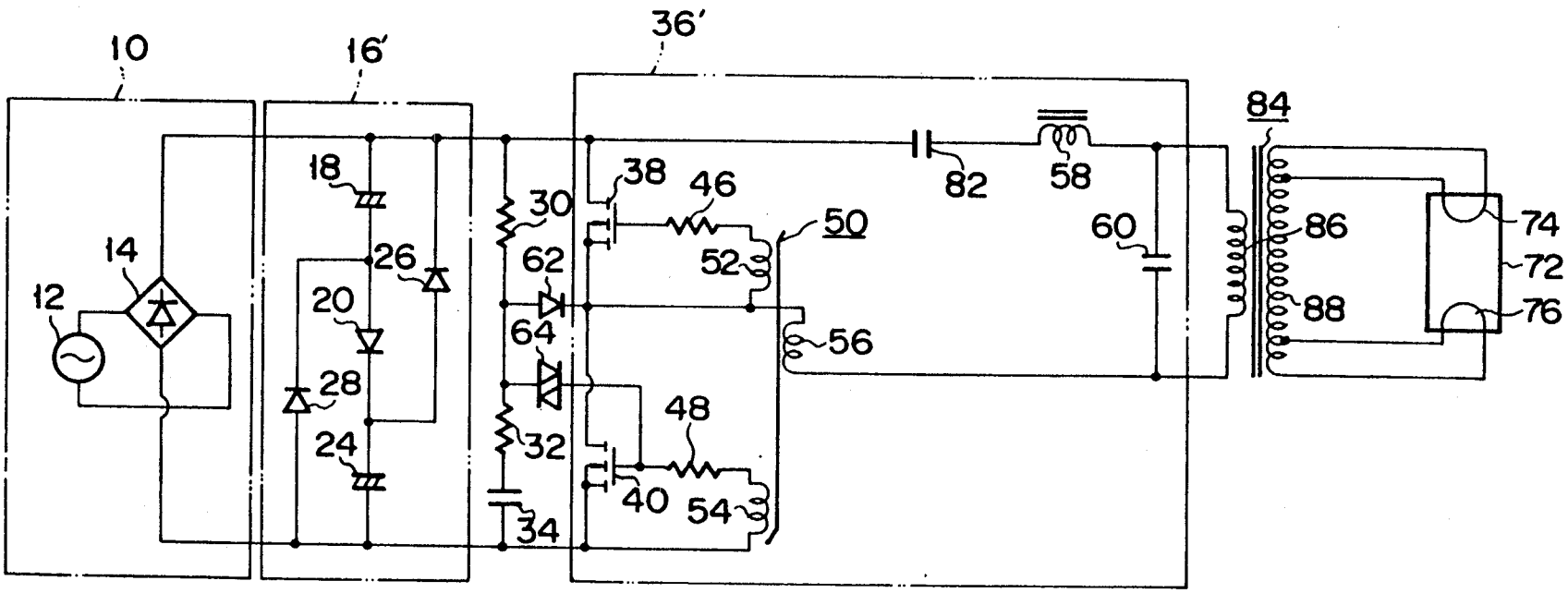
FIG. 6 is a circuit diagram showing the second embodiment of a discharge lamp lighting apparatus of the present invention.

A circuit shown in FIG. 6 is used to light a one-lamp discharge lamp 72 having filaments 74 and 76 and has a smoothing circuit 16' obtained by omitting the resistor 22 from the smoothing circuit 16 of the circuit shown in FIG. 1. In an inverter 36', the series circuit constituted by the choke coil 58 and the capacitor 60 of the inverter 36 in FIG. 1 is connected from the positive output terminal of a rectifier 14 via a capacitor 82. An input winding 86 of a boosting transformer 84 is connected to the capacitor 60 of the series resonance circuit. An output winding 88 of the transformer 84 is connected to the filaments 74 and 76 of the discharge lamp 72.

An operation of the second embodiment is the same as that of the first embodiment described above and a detailed description thereof will be omitted.

As described above, since the transformer is connected in parallel with the capacitor of the inverter, a small transformer can be used even when the number of transformers is increased. As a result, the entire apparatus can be miniaturized.

In an ordinary discharge lamp lighting apparatus, a predetermined operation is performed regardless of the state of a discharge lamp as a load. For this reason, if a load voltage is increased or an over-input of a half-bridge type inverter occurs toward the end of the service life of the discharge lamp, a switching element (field-effect transistor) may be destroyed. In the following embodiment, while miniaturization of an apparatus is achieved, a winding for voltage detection is provided in a transformer so as to prevent the switching element from being destroyed by a load variation.

Figure 7:
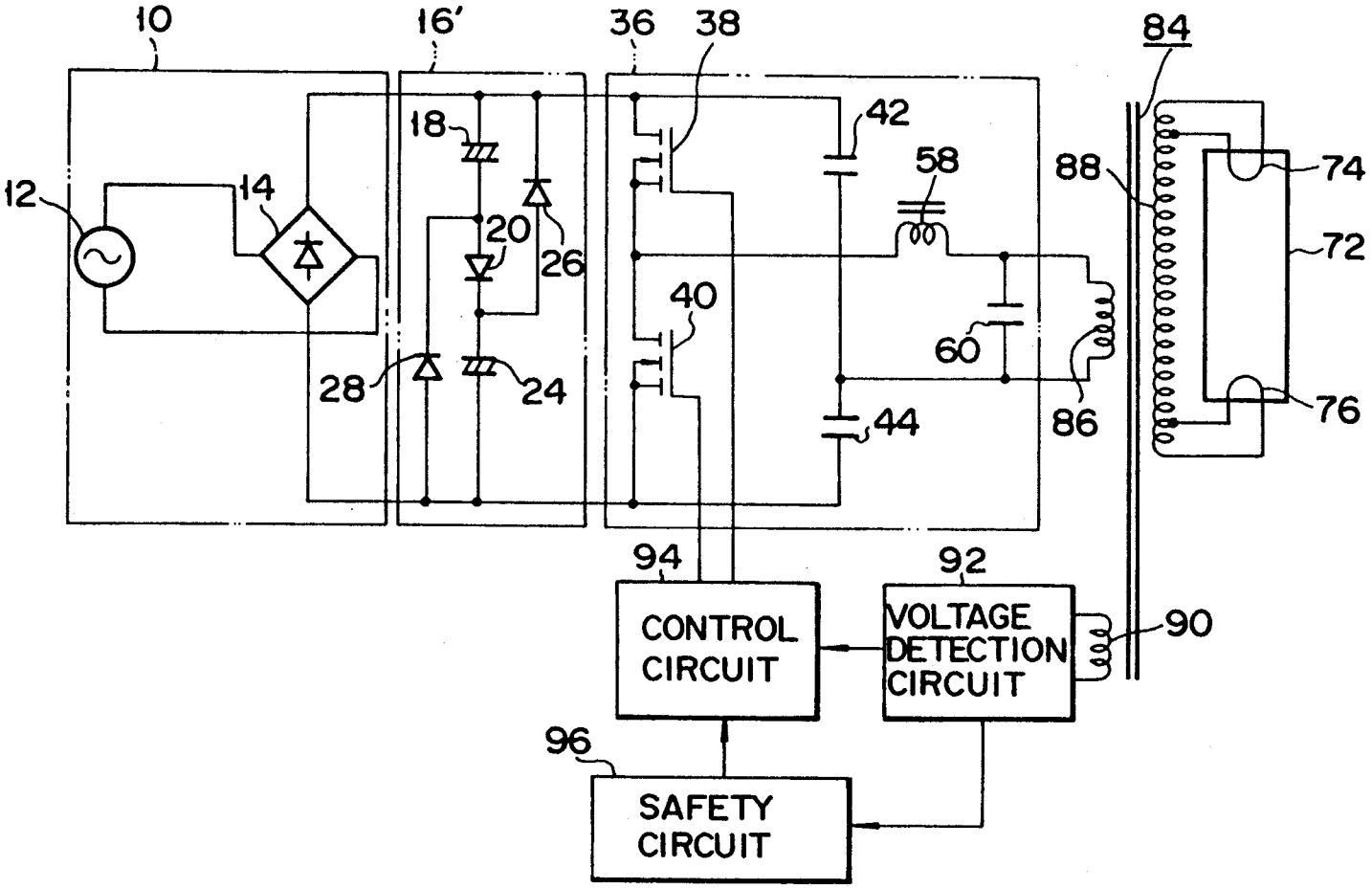
FIG. 7 is a circuit diagram showing the third embodiment of a discharge lamp lighting apparatus of the present invention.

FIG. 7 is a circuit diagram showing the third embodiment of a discharge lamp lighting apparatus according to the present invention. Referring to FIG. 7, a smoothing circuit 16' and a half-bridge type inverter 36 as a current-resonant type inverter having field-effect transistors 38 and 40 as switching elements are connected between the output terminals of a rectifier 14 which constitutes a DC power source 10 together with a commercial AC power source 12.

A voltage detection winding 90 is provided in a boosting transformer 84, and a voltage detection circuit 92 is connected to the transformer 84 through the winding 90. The voltage detection circuit 92 is connected to a control circuit 94 and a safety circuit 96. The control circuit 94 is connected to the safety circuit 96 and the gates of the transistors 38 and 40.

An operation of this embodiment will be described below.

A commercial AC supplied from the commercial AC power source 12 is rectified by the rectifier 14 and smoothed by the smoothing circuit. The smoothed current is inverted into a high frequency by the inverter 36, and discharge lamps $72_1$ and $72_2$ are turned on at a high frequency. A load voltage from the voltage detection winding 90 of the transformer 84 is detected by the voltage detection circuit 92. The control circuit 94 performs a ON/OFF operation of the field-effect transistors 38 and 40 on the basis of the load voltage detected by the voltage detection circuit 92. When the load voltage is largely increased, oscillation of the half-bridge type inverter 36 is stopped by an operation of the safety circuit 96.

A practical circuit of the third embodiment will be described below with reference to FIG. 8 by taking a two-lamp discharge lamp as an example.

Figure 8:
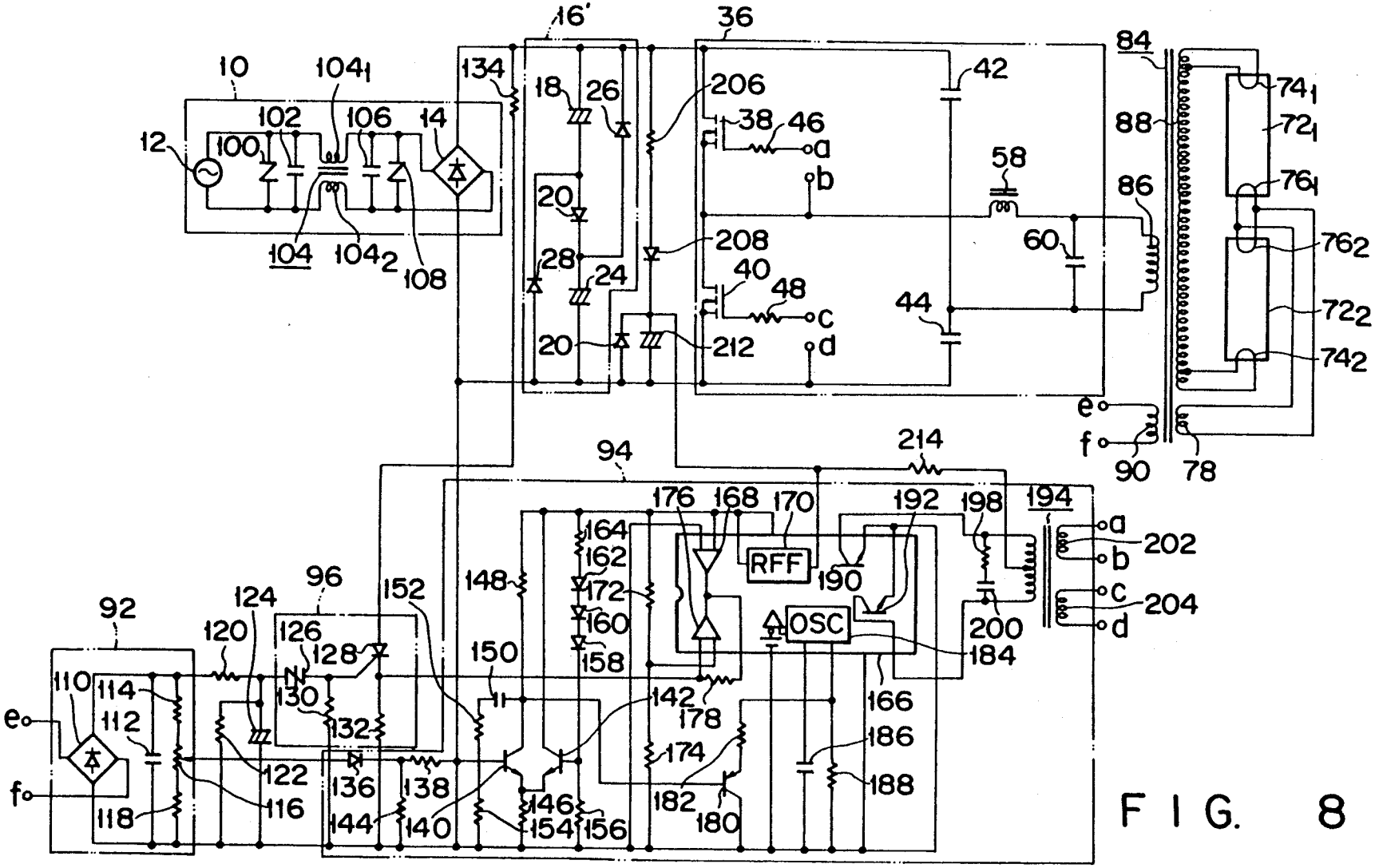
FIG. 8 is a circuit diagram showing the fourth embodiment of a discharge lamp lighting apparatus of the present invention.

FIG. 8 is a circuit diagram showing the fourth embodiment of a discharge lamp lighting apparatus according to the present invention. Referring to FIG. 8, a DC power source 10 is connected to the input terminal of a rectifier 14 via a commercial AC power source 12, a constant-voltage element 100, a capacitor 102, a primary winding $104_1$ and a secondary winding $104_2$ of an inductor transformer 104, a capacitor 106, and a constant-voltage element 108.

Resistors 46 and 48 are connected to the gates of field-effect transistors 38 and 40, respectively, of a half-bridge type inverter 36. Discharge lamps $72_1$ and $72_2$ respectively having filaments $74_1$ and $76_2$ and filaments $74_2$ and $76_2$ are cascade-connected to an output winding 88 of a transformer 84. A filament winding 78 provided in the transformer 84 is connected between the discharge lamps $72_1$ and $72_2$.

The input terminal of a rectifier 110 of a voltage detection circuit 92 is connected to a voltage detection winding 90. A series circuit constituted by a capacitor 112, a resistor 114, a variable resistor 116, and a resistor 118 is parallel-connected between the output terminals of the rectifier 110. A resistor 122 and an electrolytic capacitor 124 are connected in parallel with the output terminal of the rectifier 110 via a resistor 120. The gate of a thyristor 128 is connected to a node between the resistor 120 and a node between the resistor 122 and the capacitor 124 via a trigger element 126 of a safety circuit 96. The gate and cathode of the thyristor 128 are connected to the negative output terminal of the rectifier 11 via resistors 130 and 132, and its anode is connected to the positive output terminal of a rectifier 134 of the DC power source 10 via the resistor 130.

The variable terminal of the variable resistor 116 is connected to the base of a transistor 140 via a diode 136 and a resistor 138 of a control circuit 94. A resistor 144 is connected between a node between the diode 136 and the resistor 138 and the negative output terminal of the rectifier 110. The emitter of the transistor 140 is connected to the emitter of a transistor 142 and to the negative output terminal o the rectifier 110 via a resistor 146. The collector of the transistor 140 is connected to the collector of the transistor 142 via a resistor 148 and to the negative output terminal of the rectifier 110 via a capacitor 150 and resistors 152 and 154. The base of the transistor 142 is connected to the negative output terminal of the rectifier 110 via a resistor 156 and to a comparator 168 and a reference circuit 170 of an 166 via diodes 158, 160, and 162 and a resistor 164.

Voltage-dividing resistors 172 and 174 are connected to a node between the resistor 164 and the IC 166. A node between the resistors 172 and 174 is connected to a comparator 176 of the IC 166 and to the output terminals of the comparators 168 and 176 via a resistor 178. The collector of the transistor 140 is connected to the base of a transistor 180, and the collector of the transistor 180 is connected to the negative output terminal of the rectifier 110. The emitter of the transistor 180 is connected to an oscillator 184 via a resistor 182. A capacitor 186 and a resistor 188 are parallel-connected between the negative output terminals of the oscillator 184 and the rectifier 110.

The emitter of each of transistors 190 and 192 of the IC 166 is connected to the negative output terminal of the rectifier 110, and its collector is connected between the two ends of an input winding 196 of a control transformer 194. A series circuit constituted by a resistor 198 and a capacitor 200 is connected in parallel with the input winding 196 of the control transformer 194. A first output winding 202 of the transformer 194 is connected to the gate and source of the field-effect transistor 38 via the resistor 46, and its second output winding 204 is connected to the gate and source of the field-effect transistor 40 through the resistor 48. A relationship between the first and second output windings 202 and 204 is so set a to induce voltages in opposite directions.

A resistor 206, a diode 208, and a parallel circuit of a diode 210 and an electrolytic capacitor 212 are series-connected between the two terminals of the DC power source 10. The input winding 196 of the control transformer 194 is connected to a node between the diode 208 and the electrolytic capacitor 212.

In the discharge lamp lighting apparatus having the above arrangement, a voltage induced by the voltage detection winding 90 is detected by the voltage detection circuit 92. When the voltage is increased by, e.g., due to the end of the life of each of the discharge lamps $72_1$ and $72_2$, the trigger element 126 triggers the thyristor 128. When the thyristor 128 is turned on, the IC 166 stops oscillation of the half-bridge type inverter 36. When the voltage variation falls within a normal range, the output from the inverter 36 is changed by the IC 166.

Note that the DC power source is not limited to a power source for rectifying an AC but may be a battery or the like. In addition, the smoothing circuit may be simply constituted by a capacitor or another smoothing circuit or may be omitted.

What is claimed is:

1. A discharge lamp lighting apparatus comprising:

DC power source means;

inverter means connected to the DC power source means, the inverter means including:

a series resonance circuit having an inductor and a first capacitor, and a first and second switching means connected in series with the DC power source means;

transformer means having input and output windings, the input winding connected in parallel with the first capacitor;

at least one discharge lamp having a pair of filaments connected to the output winding; and wherein the inverter means has second and third capacitors connected in series with the DC power source means, and the series resonance circuit is connected between a node between the first and second switching means and a node between the second and third capacitors.

2. An apparatus according to claim 1, wherein the first and second switching means are constituted by field-effect transistors.

3. An apparatus according to claim 1, wherein the DC power source means includes AC power source means and a full-wave rectifier, connected to the AC power source means, for performing full-wave rectification.

4. An apparatus according to claim 3, further comprising a smoothing circuit connected between an output terminal of said full-wave rectifier and said inverter means.

5. A discharge lamp lighting apparatus comprising:

DC power source means;

inverter means connected to the DC power source means, the inverter means including:

a series resonance circuit having an inductor and a first capacitor, and a first and second switching means connected in series with the DC power source means;

transformer means having input, output, and voltage detection windings, the input winding connected in parallel with the first capacitor;

at least one discharge lamp having a pair of filaments connected to the output winding; and control means connected between the voltage detection winding and the first and second switching means for controlling the first and second switching means in accordance with a voltage detected by the detection winding.

6. An apparatus according to claim 5, wherein the control means includes a voltage detection circuit for detecting the voltage detected by the voltage detection winding and a control circuit for alternately switching on/off the first and second switching means in accordance with the voltage detected by the voltage detection circuit.

7. An apparatus according to claim 6, wherein the control means further includes a safety circuit for stopping an operation of the first and second switching means controlled by the control circuit when an abnormal voltage is detected by the voltage detection winding.

8. An apparatus according to claim 1, wherein the inductor of said inverter means is constituted by a resonant choke coil.

9. A discharge lamp lighting apparatus comprising:

DC power source means;

inverter means connected to the DC power source means, the inverter means including:

a series resonance circuit having an inductor and a first capacitor, a first and second switching means connected in series with the DC power source means, a node between the first and second switching means being connected to the first capacitor, and a second capacitor connected between the DC power source means and the inductor;

transformer means having input and output windings, the input winding connected in parallel with the first capacitor; and at least one discharge lamp having a pair of filaments connected to the output winding.

* * * * *